United States Patent [19]

Greer

[11] 4,182,236

[45] Jan. 8, 1980

[54] VERTICAL BALER WITH IMPROVED MATERIAL HOLD-DOWN AND BALE EJECTING MEANS

[75] Inventor: Charles H. Greer, Urbana, Ohio

[73] Assignee: Piqua Engineering, Inc., Piqua, Ohio

[21] Appl. No.: 965,182

[22] Filed: Nov. 30, 1978

[51] Int. Cl.[2] ..... B65B 13/06; B30B 15/32

[52] U.S. Cl. ..... 100/8; 100/3; 100/53; 100/218; 100/220; 100/255

[58] Field of Search ..... 100/53, 220, 3, 255, 100/8, 218

[56] References Cited

U.S. PATENT DOCUMENTS

| | | | |
|---|---|---|---|
| 181,632 | 8/1876 | Brock | 100/218 X |
| 1,040,396 | 10/1912 | Paal | 100/218 |
| 3,677,175 | 7/1972 | Marvin | 100/218 X |
| 3,728,959 | 4/1973 | Fredrickson | 100/218 |
| 3,851,577 | 12/1974 | Newcom | 100/218 |
| 3,885,466 | 5/1975 | Cerniglia | 100/218 |
| 3,916,781 | 11/1975 | Cerniglia | 100/218 |

*Primary Examiner*—Billy J. Wilhite

*Attorney, Agent, or Firm*—Jacox & Meckstroth

[57] ABSTRACT

A vertical baler has a generally rectangular compacting chamber defined by vertical wall members extending from a base, and the chamber is closed by pivotal front doors and a vertically retractable safety gate. A vertically movable horizontal platen is suspended within the chamber by a hydraulic cylinder, and batches of scrap material compacted within the chamber are held down by dog members some of which are pivotally supported. A set of flexible bale ejecting members are coupled to the pivotal dog members and bias the dog members inwardly into the chamber when compacting material, and the ejecting members are then coupled to the platen to provide for ejecting a tied bale in response to upward retraction of the platen.

9 Claims, 4 Drawing Figures

VERTICAL BALER WITH IMPROVED MATERIAL HOLD-DOWN AND BALE EJECTING MEANS

BACKGROUND OF THE INVENTION

In a vertical baler for scrap material, for example, of the type disclosed in U.S. Pat. No. 3,851,577 now assigned to the assignee of the present invention, a generally rectangular compacting chamber is defined between parallel spaced vertical end walls mounted on a base forming a bottom wall, and the rear wall for the chamber is formed by a series of parallel spaced channel members defining vertical slots therebetween. One or two front doors are pivotally connected to the end walls and form the front wall of the compacting chamber. A horizontal rectangular platen is suspended within the chamber by the ram or piston rod of a vertical hydraulic cylinder which is supported by a frame forming the top wall of the baler. The opposing bottom wall and platen are each provided with means defining parallel spaced slots which align with the slots in the rear wall and provide for extending tie cords or wires around a bale of material while the bale remains compacted by the platen and after the front doors are opened.

In such a baler, it has been found desirable to provide the front doors and back wall with triangular shaped hold-down teeth or fixed dog members which maintain some compaction of the material when the platen is raised for receiving another batch of scrap material supplied to the chamber through an opening above the front doors of the baler. As disclosed in the above patent, it has also been found desirable to provide a vertical baler with a set of flexible bale ejecting members which extend across the bottom wall of the baler through the slots in the back wall and are adapted to be hooked onto the platen after a bale is tied. When the platen is elevated or retracted upwardly, the flexible ejecting members roll the bale out of the compacting chamber and onto some means for transporting the bale such as a wheeled cart. A problem arises when the material hold-down dog members are made relatively large to make them more effective in holding down the compacted material when the platen is raised for receiving additional material. If the dog members are not retracted before a tied bale is ejected, the platen and ejecting members may be subjected to substantial stress which can easily break a flexible ejecting member or damage the platen and its supporting hydraulic cylinder.

SUMMARY OF THE INVENTION

The present invention is directed to a baler incorporating improved material hold-down means and bale ejecting means. The improvement of the invention not only provides material hold-down members which are retractable for bale ejection, but which also assure that the material hold-down members will be retracted before a tied bale can be ejected. In general, the above features are provided in accordance with a preferred embodiment of the invention by mounting on the rear wall of the baler a plurality of pivotally supported and relatively large dog members which normally hang or are suspended in a retracted position. The rearward end of each flexible ejecting member is provided with a coupler which is adapted to engage the adjacent dog member when the baler is being used to compact material. The weight of the coupler and the flexible ejecting member is effective to bias the dog member resiliently inwardly into the compacting chamber so that the dog member effectively restrains the compacted material within the chamber. When each ejecting member is uncoupled from the dog member for coupling the ejecting member to the platen, the dog member automatically pivots to its retracted position so that it does not interfere with removing the bale by elevating the ejecting members.

Other features and advantages of the invention will be apparent from the following description, the accompanying drawing and the appended claims.

DESCRIPTION OF THE PREFERRED EMBODIMENT

Figure 1:
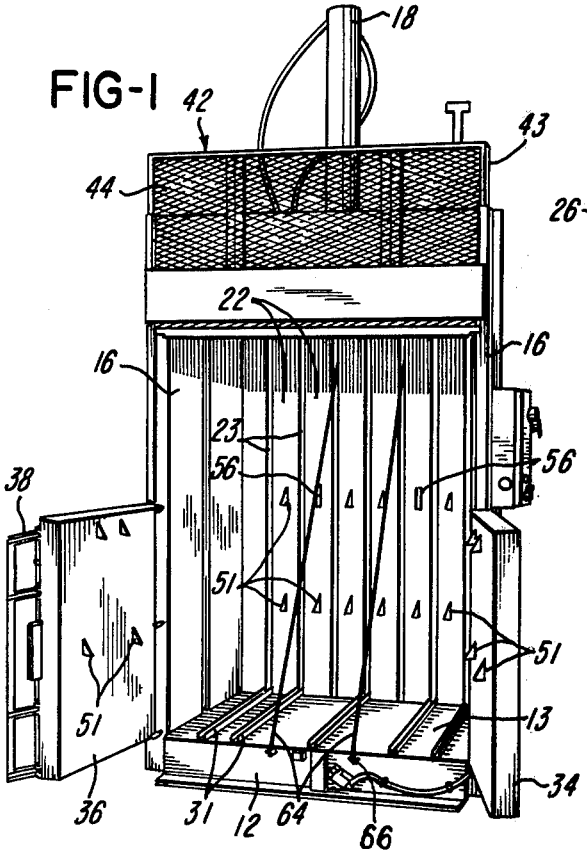
FIG. 1 is a perspective view of a vertical baler constructed in accordance with the invention and illustrating the baler after a bale has been ejected.

FIG. 1 illustrates a vertical compactor or baler constructed generally in accordance with the disclosure of above-mentioned U.S. Pat. No. 3,851,577 and which includes a rectangular base 12 forming a bottom wall 13. A pair of opposing fabricated steel end walls 16 have lower end portions rigidly connected to the base 12 and upper end portions rigidly connected by a frame (not shown). The frame also supports a vertical hydraulic cylinder 18 and includes a housing portion forming a hydraulic reservoir for the cylinder 18. The back or rear wall of the baler is formed by a series of vertical steel channel members 22 which are horizontally spaced to define slots 23 therebetween.

The reciprocating ram or piston rod of the hydraulic cylinder 18 supports a horizontal rectangular platen 25 which is formed by a series of parallel spaced channel members 26 (FIG. 2) rigidly connected by a set of cross channels 28. The horizontal spaces or slots 29 defined between the channels 26 of the platen 25 align with the slots 23 defined between the rear wall channel members 22, and a series of channels 31 (FIG. 1) are mounted on the bottom wall 13 also in alignment with the slots 23. The end walls 16 cooperate with the bottom wall 13 and the rear wall channel members 22 to define a generally rectangular compacting chamber within which the platen 25 moves vertically between its lower extended position and its upper retracted position (FIG. 1).

A set of fabricated steel doors 34 and 36 are pivotally supported by the end walls 16 for movement between open positions (FIG. 1) and closed positions where the doors close the lower portion of the compacting chamber and are rigidly connected to each other and to the base 12 by a manually actuated latch 38. A rectangular safety gate 42 is formed by a rectangular frame 43 enclosing a wire mesh grid 44 and is supported for vertical reciprocating movement between a retracted upper position (FIG. 1) and a lower portion directly above the doors 34 and 36 in their closed positions.

When the doors 34 and 36 are closed and the platen 25 and safety gate 42 are in their upper retracted positions, scrap material is loaded into the compacting chamber through the opening above the closed doors 34 and 36. After a batch of scrap material is received within the compacting chamber, the gate 42 is lowered and the cylinder 18 is actuated so that the platen 25 compacts the material within the lower portion of the chamber. In order to restrain the compacted material, a series of triangular shaped flat dog members or teeth 51 are rigidly secured to the doors 34 and 36 and to the rear wall channel members 22.

Figure 4:
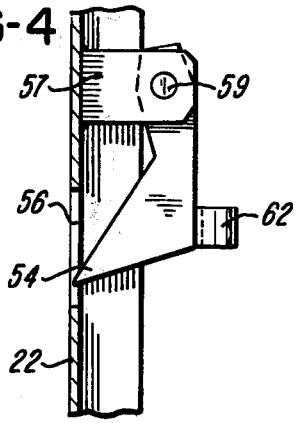
FIG. 4 is a fragmentary section similar to FIG. 2 and illustrating the retracted position of a dog member when a bale is ready for ejection as shown in FIG. 3.

In addition to the hold down teeth 51, the compacted material is also held down within the chamber by a set of hold-down or dog members 54 (FIG. 2) which project through corresponding vertical slots 56 formed within the rear wall channel members 22. Each of the dog members 54 includes an upper portion which extends between parallel spaced flanges 57 projecting rearwardly from the adjacent channel member 22 above the corresponding slot 56, and the dog member is pivotally supported by a cross shaft or bolt 59 extending through aligned holes within the dog member 54 and flanges 57. A short sleeve or tube 62 is rigidly secured or welded to the lower outer edge surface of each of the dog members 54, and the normal hanging or depending position of the dog member is in its retracted position, as shown in FIG. 4.

A pair of flexible bale ejecting members or cables 64 (FIG. 1) have lower end portions rigidly secured to the base 12 by fasteners 66. Each cable 64 normally extends rearwardly across the bottom wall 13 of the base 12 and through an aligned slot 23. The rearward or upper end portion of each bale ejecting cable 64 extends through a hole 69 formed within a channel member 71 of a coupler 72. A slot 73 is formed within the upper end portion of the channel member 71, and the end portion of the cable 64 is clamped to a rod 76 extending across the slot 73 and rigidly secured to the channel member 71. An elongated rod 78 extends through the slot 73 within each of the channel members 71 and forms an inner hook portion 81 and an outer handle portion 82.

Figure 2:
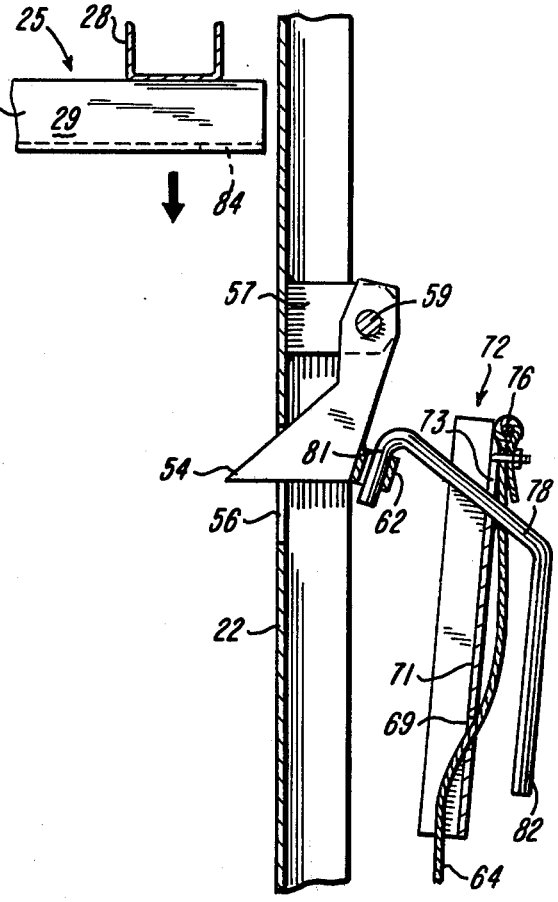
FIG. 2 is a fragmentary vertical section through the rear wall of the baler and showing an ejecting member coupled to a dog member prior to compacting material by the platen.

Referring to FIG. 2, when material is being compacted within the baler chamber by the platen 25, the hook portion 81 of each coupler 72 is inserted into the tube 62 of the corresponding dog member 54 so that the coupler projects in a cantilevered manner from the coupler 72. The weight of the ejecting cable 64 and coupler 72 is effective to pivot the dog member 54 clockwise to its extended position (FIG. 2) where the dog member projects inwardly through its corresponding slot 56 and into the compacting chamber. When the material is compacted downwardly within the chamber by the platen 25, the dog members 54 are cammed outwardly against the bias provided by the weight of the ejecting couplers 72 and cables 64 until the platen arrives at a lower position below the dog members 54 which then pivot inwardly above the platen 25. A set of slots 84 (FIG. 2) are formed within the channel members 26 of the platen 25 in alignment with the dog members 54, and the dog members 54 pass through the slots 86 when the platen 25 is retracted upwardly. Thus the extended dog members 54 cooperate with the teeth 51 to hold down the compacted material and restrain the material from springing upwardly when the platen 25 is retracted.

Figure 3:
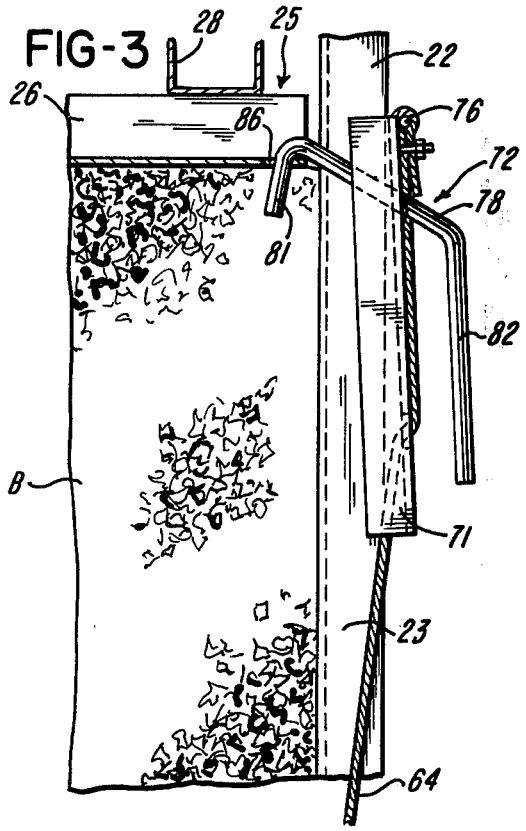
FIG. 3 is a fragmentary vertical section similar to FIG. 2 and illustrating an ejecting member coupled to the platen for ejecting a tied bale from the compacting chamber.

After sufficient material has been compacted within the chamber to form a bale B, (FIG. 3), the doors 34 and 36 are opened while the platen 25 continues to be extended to hold the material in a compacted bale. A set of tie cords or wires (not shown) are extended or fed rearwardly through the channels 31 and through the slots 23. The wires are then extended or fed forwardly back through the slots 23 and the slots 29 defined between the channel members 26 of the platen 25. The cords or wires are tied or twisted together at the front of the bale to prevent the compacted material from expanding when the platen 25 is retracted upwardly.

After the bale is tied with the surrounding cords or wires and it is desired to eject the bale, the couplers 72 connected to the two ejecting members or cables 64 are removed or unhooked from the corresponding hold down or dog members 54, and the hook portions 81 of the couplers 72 are inserted through corresponding slots 23 and into corresponding holes 86, (FIG. 3) within the channel members 26 of the platen 25. When the couplers 72 are removed from the dog members 54, the dog members automatically pivot counter-clockwise to their retracted positions (FIG. 4). When the platen 25 is elevated by actuating the cylinder 18, the couplers 72 move upwardly with the platen so that the flexible ejecting cables 64 roll the tied bale from the compacting chamber onto some form of transporting means such as a wheel supported cart. After the bale is ejected by moving the ejector cables 64 to the positions shown in FIG. 1, the platen 25 is lowered, and the couplers 72 are disconnected from the platen 25 and are hooked back onto the dog members 54 so that the dog members are pivoted to their extended positions as shown in FIG. 2.

From the drawing and the above description, it is apparent that a compactor or baler constructed in accordance with the present invention, provides desirable features and advantages. For example, by using the ejecting cable couplers 72 as a means for biasing the dog members 54 inwardly during compacting of material within the baler, the dog members 54 are assured of being retracted before the ejecting cables 64 are connected to the platen 25 by the couplers 72. As a result, each bale is ejected without any resistance produced by the retracted dog members 54. Thus the couplers 72 provide for resiliently biasing the dog members 54 to their extended positions projecting into the compacting chamber and also provide for connecting the ejecting cables 64 to the platen 25 for ejecting the bale from the compacting chamber.

While the form of baler apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In a baler including means defining a compacting chamber adapted to receive scrap material, a platen disposed within the chamber, power operated means for moving the platen between a retracted position and an extended position to provide for adding material to the chamber and to effect pressing of the material into a bale, means providing for trying a compacted bale with a flexible tie member, at least one material hold-down member supported for movement between an extended position for engaging the material within the chamber and a retracted position to permit ejecting of the bale from the chamber, and an ejecting member adapted to be connected to the platen for ejecting the bale from the chamber in response to movement of the platen towards its retracted position, the improvement comprising means connecting the hold-down member and the ejecting member and effective to assure movement of the hold-down member to its retracted position prior to connecting the ejecting member to the platen.

2. A baler as defined in claim 1 wherein the hold-down member is supported for movement to its retracted position in response to material being compacted within the chamber by the platen, and the connecting means effectively urge the hold-down member towards its extended position.

3. A baler as defined in claim 1 wherein the hold-down member comprises a dog member supported for pivotal movement between the retracted and extended positions, and means associated with the ejecting member for resiliently biasing the dog member towards its extended position.

4. A baler as defined in claim 3 wherein the ejecting member includes an elongated flexible member, means including a coupler for releasably connecting the flexible member to the dog member, and the weight of the coupler is effective to aid in pivoting the dog member towards its extended position.

5. A baler as defined in claim 1 including a plurality of wall members spaced to define slots therebetween, at least one elongated flexible ejecting member extending through one of the slots, a coupler for releasably connecting the ejecting member to the hold-down member and for maintaining the hold-down member in its extended position, and the coupler also releasably connects the ejecting member to the platen through one of the slots.

6. A baler as defined in claim 5 wherein the hold-down member is pivotally supported by one of the wall members, and the coupler includes a hook portion for engaging the hold-down member to effect pivoting of the hold-down member towards its extended position.

7. In a baler including a vertical housing defining a compacting chamber having a front opening and adapted to receive scrap material, door means for closing the front opening, a platen disposed within the chamber, power operated hydraulic cylinder means for moving the platen vertically between a retracted upper position and an extended lower position to provide for adding material to the chamber over the door means and to effect pressing of the material into a bale, at least one material hold-down member supported for movement between an extended position for engaging the material within the chamber and a retracted position to permit ejecting of the bale from the chamber through the front opening, a flexible ejecting member adapted to be releasably connected to the platen for ejecting the bale from the chamber in response to movement of the platen upwardly towards its retracted position, the improvement comprising means supporting the hold-down member for pivotal movement, and means releasably connecting the ejecting member to the hold-down member and for resiliently pivoting the hold-down member towards its extended position while compacting material within the chamber.

8. A baler as defined in claim 7 wherein the housing includes spaced vertical members forming a rear wall, the hold-down member is supported for pivotal movement through a slot in the rear wall to its retracted position in response to material being compacted within the chamber by the platen, and the connecting means comprises a coupler having a hook portion for releasably engaging the hold-down member.

9. A baler as defined in claim 8 wherein the hold-down member comprises a dog member suspended for pivotal movement between the retracted and extended positions, and the dog member has means defining an opening for receiving the hook portion of the coupler.

* * * * *